US011844411B2

(12) United States Patent
Zheng et al.

(10) Patent No.: US 11,844,411 B2
(45) Date of Patent: Dec. 19, 2023

(54) DROPPER PACKAGE FOR DISPENSING A FLUID PRODUCT

(71) Applicant: APR Beauty Group, Inc., Toronto (CA)

(72) Inventors: Min-Yan Zheng, Richmond Hill (CA); Feng-Ying Fu, Markham (CA); Jun Shen, Lighthouse Point, FL (US)

(73) Assignee: APR Beauty Group, Inc., Toronto (CA)

( * ) Notice: Subject to any disclaimer, the term of this patent is extended or adjusted under 35 U.S.C. 154(b) by 206 days.

(21) Appl. No.: 17/671,694

(22) Filed: Feb. 15, 2022

(65) Prior Publication Data

US 2023/0255339 A1 Aug. 17, 2023

(51) Int. Cl.
*A45D 34/04* (2006.01)
*B65D 47/18* (2006.01)

(52) U.S. Cl.
CPC ..... *A45D 34/04* (2013.01); *A45D 34/045* (2013.01); *A45D 34/046* (2013.01); *B65D 47/18* (2013.01); *A45D 2200/10* (2013.01); *A45D 2200/1009* (2013.01); *A45D 2200/15* (2013.01); *B65D 2547/04* (2013.01)

(58) Field of Classification Search
CPC ..... A45D 34/045; A45D 34/046; A45D 2200/1009; B65D 47/18; B65D 2547/04
USPC ..... 401/126
See application file for complete search history.

(56) References Cited

U.S. PATENT DOCUMENTS

| | | | | |
|---|---|---|---|---|
| 10,010,151 | B2 * | 7/2018 | Gueret | A45D 34/045 |
| 2020/0288842 | A1 | 9/2020 | Maurin et al. | |
| 2020/0329846 | A1 * | 10/2020 | Bianco | A45D 40/267 |
| 2021/0212449 | A1 * | 7/2021 | Dai | A45D 34/046 |
| 2023/0276921 | A1 * | 9/2023 | Zheng | B65D 47/18 132/317 |

FOREIGN PATENT DOCUMENTS

| | | | | |
|---|---|---|---|---|
| CN | 109588844 A | * | 4/2019 | A45D 34/045 |

* cited by examiner

*Primary Examiner* — Jennifer C Chiang
(74) *Attorney, Agent, or Firm* — Jason Lee DeFrancesco

(57) ABSTRACT

A dropper package for dispensing and applying a fluid product, comprising a container body for storing the fluid product and a dropper assembly coupled to one end of the container body. The dropper assembly comprises a deformable bulb, a tube with its proximal end connected to the deformable bulb, and an applicator tip connected to a distal end of the tube. The applicator tip comprises two main application faces that are opposite to each other and a central through cavity that opens to the outside from both the main application faces. The applicator tip includes a dispensing channel that is in fluid communication with a channel of the tube and terminates in a dispensing orifice that opens into the central through cavity. The dropper package is adapted to apply and dispense the fluid product in a very controlled manner as well as massage the user's keratinous surface.

20 Claims, 8 Drawing Sheets

DROPPER PACKAGE FOR DISPENSING A FLUID PRODUCT

BACKGROUND

Field of the Invention

The present disclosure relates to a dropper package for applying and dispensing a fluid product, such as cosmetic product, pharmaceutical products etc. More particularly, the present disclosure relates to a dropper package having an applicator tip for a controlled delivery of a fluid product onto the keratinous surface of the user.

Description of the Related Art

In the personal and beauty care application space, dispensers are often used to dispense products used on a user's skin, such as make-up products, beauty enhancers, serums, and other liquids. In some instances, such products may be dispensed with a conventional bulb-dropper dispenser. Conventional bulb-droppers generally include a flexible bulb attached to one open end of a rigid tube. To use such a device, a user may squeeze the deformable bulb and insert the opposite open end of the rigid tube into a liquid or fluid product and release the deformable bulb. Upon release of the deformable bulb, a vacuum is formed, resulting in the drawing of liquid into the ridged tube. To dispense the liquid from the rigid tube, the user may again squeeze the deformable bulb, forcing the liquid or fluid out of the rigid tube and onto a desired surface such as the user's skin, a cloth, or other substrate. Conventional bulb-droppers have also been adapted for use with containers or bottles such that the deformable bulb-dropper also includes a collar capable of being attached to a container or bottle for storage and shipping.

Many of such dropper packages include an applicator attached to a tube for drawing product from the applicator and applying product to the user's skin, hair, etc. During use, the dropper squeezes.

U.S patent application "US20200288842A1" discloses a dropper including a cap connectable to a bottle; a depressible actuator coupled to the cap, a shaft coupled to the depressible actuator, wherein the shaft includes a thermal tip; wherein liquid cosmetic product is introduced into an opening in the thermal tip by depressing and releasing the depressible actuator.

In such dropper packages, when the liquid product flows out, sometimes it is difficult to control the flow of the low viscosity fluid product and they may easily drip from the applicator.

Alternative approaches to such applicators are desired. Still, there is a need for a dropper package that includes an applicator that retains the fluid product, avoids dripping of the fluid product during application, and provides treatment to user's skin on both a smaller and a larger application area effectively.

SUMMARY

It is an object of the present disclosure to provide a dropper package for dispensing and applying a fluid product including a cosmetic, care, or pharmaceutical product.

It is an object of the present disclosure to provide an applicator tip that avoids dripping of the fluid product during application, offers a controlled fluid flow, is simple to use, aesthetically pleasing, and can offer massage to the keratinous surface.

Further, an applicator tip is desired which is comfortable, easier to handle and have controlled delivery onto the skin.

Accordingly there is provided a dropper package comprises a container body and a dropper assembly secured to the container body. The dropper assembly includes a cap that is connectable to the container body, a deformable bulb coupled to the cap and defining an interior chamber, a tube coupled to the deformable bulb, an applicator tip coupled to a distal end of the tube, wherein the tube has a channel that is in fluid communication with the interior chamber of the deformable bulb, wherein the applicator tip includes a dispensing channel that is in fluid communication with the channel of the tube, wherein the applicator tip includes a central through cavity; and wherein the channel of the applicator tip terminates in an dispensing orifice formed at an inner periphery of the applicator tip that surrounds the central through cavity.

According to an aspect of the present disclosure, the dropper package comprises the container body and the dropper assembly secured to the container body. The dropper assembly includes the cap configured to be coupled to the container body when the cosmetic package is not in use. This dropper package extends longitudinally along a longitudinal axis. The container body comprises a hollow reservoir for containing a fluid product including a cosmetic, care, or pharmaceutical product. The cosmetic, care or pharmaceutical product includes fluidic cosmetics, gloss, serum, skincare, under-eye cosmetics, pharmaceutical, and like products.

According to another aspect of the present disclosure, the dropper assembly includes a push button, the cap, an inner screw member, the deformable bulb, the tube, a connector, and the applicator tip. The tube and the applicator tip are adapted to be inserted into the container body containing the fluid product when the cap is engaged onto the container body.

According to an aspect of the present disclosure, an upper portion of the container body forms a neck portion and defines an opening at its upper end. The neck portion of the container body has screw threads formed on an outer peripheral surface thereof. The screw threads of the container body are configured to be screwed with the inner screw member of the dropper assembly to seal the container body. The inner screw member is provided at a lower inner side of the cap and has screw threads formed at an inner circumferential surface thereof. The screw threads of the inner screw member are screwed with the screw threads of the container body to open and close the container body.

According to yet another aspect of the present disclosure, the cap is coupled to the push button at an upper end thereof. Furthermore, the cap has an opening defined at the center of a top surface of the cap. The top surface of the cap is formed as a locking surface that surrounds the opening. When the push button is coupled to an upper inner side of the cap, the locking surface does not allow the push button to be separated from the cap. Furthermore, the push button has a cylindrical upper wall and a cylindrical lower wall that is stepped out from the cylindrical upper wall. The cylindrical upper wall of the push button has a diameter lesser than the opening of the cap so that the cylindrical upper wall projects out from the opening, and the cylindrical lower wall has a diameter greater than the diameter of the opening of the cap such that the cylindrical lower wall of the push button is retained inside the cap and the push button cannot be separated from the cap.

According to yet another aspect of the present disclosure, a wiper is fitted into the opening of the container body. The wiper is attached to the inner periphery of the neck portion of the container body member. A wiper lip is formed at the lower end of the wiper through which the tube and the applicator tip enter and exit the reservoir, and the wiper lip serves to sweep off the extra product on the tube and the applicator tip. The wiper is preferably cylindrical including a central cavity. The wiper may include a plurality of incisions either extending radially or longitudinally or both. In addition, the wiper is preferably a cosmetic recovery portion that is meant to minimize the loss of fluid products by sweeping the fluid product from the assembly i.e. the tube, the connector, and the application tip.

In an embodiment, the wiper is made of plastic material. In various embodiments, the plastic material is selected from low-density polyethylene (LDPE) or polyethylene (PE).

According to yet another aspect of the present disclosure, the deformable bulb is housed inside the cap, and the tube is coupled to a lower portion of the deformable bulb. The deformable bulb is preferably made of a material that is deformed by a pressing operation of the push button and then restored to its original state, in particular, natural rubber, elastomer, NBR (acrylonitrile-butadiene rubber), silicone. The deformable bulb may be formed of one or more materials of rubber. More particularly, the deformable bulb is made of any standard appropriate oil-resistant elastic material for supporting the tube. The elastic material should exhibit a predetermined strength or elasticity and is selected from nitrile-butadiene-rubber or acrylonitrile butadiene rubber, polycarbonate, acrylic resin, or the like.

According to yet another aspect of the present disclosure, the deformable bulb is housed inside the cap such that an upper portion of the deformable bulb is located inside the push button. The tube is centrally and longitudinally inserted inside the deformable bulb. The deformable bulb has a fastening groove formed on an inner surface thereof at a lower portion of the deformable bulb, and an upper portion of the tube is fixedly coupled to the fastening groove. More particularly, the upper portion of the tube has a locking projection is formed at an outer surface of the tube and wherein the locking projection is adapted to be fixedly coupled to the fastening groove of the deformable bulb so that the tube is not separated from the deformable bulb. More particularly, the tube is fixedly and air-tightly coupled inside the fastening groove portion of the deformable bulb.

According to yet another aspect of the present disclosure, the applicator tip is present at the lower end of the tube. The applicator tip is designed to dispense, and apply the fluid product in a controlled manner as well as massage the user's surface. Particularly, the applicator tip is connected to the lower end of the tube through the connector for fluid product delivery onto the user keratinous surface. Further, the tube is elongated cylindrical and is hollow defining a channel there through for storing a predetermined amount of fluid product from the reservoir therein. The channel may be in fluid communication with a chamber in the deformable bulb and with a channel and a dispensing orifice in the applicator tip.

Further, the applicator tip is elongated along the longitudinal axis of the dropper package and has a body that is elliptical with a central through-cavity at the center of the body. In alternate embodiments, however, the applicator tip may have any other suitable shape and size as long as it has a central through-cavity. In an embodiment, the applicator tip is made of thermal material that can retain heat and provide a cooling sensation upon contact with the user's skin. The thermal material preferably is ceramic. In alternate embodiments, the applicator tip may be made of glass, steel, ceramic, or metals, wherein the metal is selected from but not limited to silver, stainless steel, platinum, aluminum, gold, copper, brass, nickel, alloys thereof.

Furthermore, in an embodiment, the applicator tip has a cylindrical connecting structure formed at its proximal end and wherein the cylindrical connecting structure includes a protrusion structure on an outer periphery for ensuring fitment with the connector. Further, the applicator tip has a generally symmetrical shape body with respect to a median plane of symmetry and comprises the central through cavity which is delimited laterally by two lateral portions or branches and axially by a distal portion of the applicator tip and a proximal portion of the applicator tip joining the branches. The central through-cavity is elongated in shape and extends along the branches which are made of a rigid thermal material. A "median plane" of symmetry divides an element longitudinally into two equal and symmetrical parts.

According to yet another aspect of the present disclosure, the central through cavity has an elliptical shape. In a preferred embodiment, the central through-cavity formed on the applicator tip is oval or elliptical, and also helps in forming surface tension in fluid product dropped on the inner periphery of the applicator tip. In alternate embodiments, however, the central through cavity may have any other suitable shape and size, and surface finish desired for a given application of the fluid product unless the surface tension is broken when in contact with the user's skin during application.

Furthermore, the applicator tip comprises at least two main application faces i.e. a front application face and a back application face. Both the front application face and back application face are opposite to each other and are symmetrical in structure. Furthermore, the central through-cavity is open to the outside through both the front and back application faces. Both the front application face and back application face are elliptical and have convex outer surfaces. In alternate embodiments, however, the front and back applicator faces may have any other suitable shape and size, and surface finish desired for a given application. The convex outer surfaces of the back and front application faces enable precise massage of small or narrow areas of the user's keratinous surface such as upper lips, under eye, etc.

The front and back application faces are intended to come into contact with the skin during the use of the applicator tip, in order to apply the fluid product contained in the central through cavity. The central through cavity opens onto the front application face through a front opening and the central through cavity is open on the outside on the back application face by a back opening. The size of the front opening of the central through cavity is larger than that of the back opening, in particular at least by 20%. In an embodiment, the central through cavity is conical with an elliptical cross-section and wherein a depth of the central through cavity extends in a direction perpendicular to the longitudinal axis of the dropper package. In other words, the central through cavity is an elliptical cone-shaped cavity. The front opening and back opening of the central through cavity are both elliptical. Therefore, the dispensing orifice of the applicator tip is visible from the front application face and not from the back application face.

According to yet another aspect of the present disclosure, the applicator tip further includes an interior dispensing channel that extends from a proximal end of the connecting structure and terminates in the dispensing orifice formed on an inner periphery of the proximal portion of the applicator tip that faces the central through cavity. In other words, the interior dispensing channel of the applicator tip opens into the central through cavity for the delivery of the cosmetic or pharmaceutical fluid product. The dispensing orifice does not lie or opens on the front application face and the back application face.

The central through cavity makes it possible to collect fluid product by surface tension so that the fluid product does not run off a collection surface formed by inner surfaces of the branches facing the central through cavity. Thus, the central through cavity increase the loading capacity of the applicator tip. In the present embodiment, the branches of the applicator tip are in form of arches that are convex toward the outside and concave towards the central through cavity defining a product collection surface. In the other words, the product collection surface, at least partially, is formed by the concave surfaces of the arched branches. The fluid product collects in the central through cavity that is at least partially formed by the branches thereby favoring the retention of the product by surface tension. The central through cavity is open toward the outside, from the front and back application faces, in which the fluid product can collect by surface tension while remaining easily accessible for the user's skin.

According to yet another aspect of the present disclosure, the central through cavity extends over more than a quarter of the width of the applicator tip as well as over more than a quarter of its length. Preferably, the front opening of the central through cavity extends over more than a third of the width of the applicator tip on the front application face and extend over more than half of the length of the applicator tip on the front application face. Preferably, the back opening of the central through cavity extends over more than a third of the width of the applicator tip on the back application face and extend over more than a third of the length of the applicator tip on the back application face. This dimension is suitable for storing the fluid product. The central through cavity is spaced from the proximal and distal ends of the applicator tip. It has a maximum depth of dimension such that is easier to empty the central through cavity on contact with the skin. The maximum depth of the central through cavity is less than 6 mm, probably between 1 mm to 5 mm. The dimensions of the central through cavity can be chosen as a function of the quantity of product which it is desired to have optionally retained. Preferably, the dimensions of the central through cavity and of the applicator tip are the following, the maximum width of the central through cavity on the front application face, measured perpendicular to the longitudinal axis of the applicator tip, 2 mm and 7 mm, and preferably between 2 mm and 4 mm, the maximum width of the central through cavity on the back application face, measured perpendicular to the longitudinal axis of the applicator tip, is between 2 mm and 7 mm, and preferably between 2 mm and 4 mm, the maximum length of the central through cavity on the front application face, measured along the longitudinal axis of the applicator tip is between 6 mm and 10 mm, and preferably between 6 mm and 8 mm, the maximum length of the central through cavity on the back application face, measured along the longitudinal axis of the applicator tip is between 4 mm and 8 mm, and preferably between 4 mm and 6 mm. The maximum width of the applicator tip, measured perpendicular to the longitudinal axis of the applicator tip is between 5 mm and 15 mm, and preferably between 7 mm and 10 mm, the length of the applicator tip, measured along the longitudinal axis of the applicator tip, is between 10 mm and 18 mm, and preferably between 11 mm and 15 mm.

According to a preferred embodiment, the front opening forms a larger elliptical opening than the elliptical opening formed by the back opening of the central through cavity. The elliptical opening formed by the front opening has a major axis that measures about 7-8 mm and a minor axis that measures about 3-4 mm; wherein the elliptical opening defined by the back opening has a major axis that measures about 5-6 mm and a minor axis that measures about 2-3 mm.

According to yet another aspect of the present disclosure, the connector includes an upper portion and a lower portion. The upper portion and the lower portion both are cylindrical. The upper portion has a diameter lesser than the diameter of the lower portion of the connector. The upper portion of the connector is coupled to a lower portion of the tube and the lower portion of the connector is coupled to an upper portion of the applicator tip. The connector is hollow that defines a channel to allow the fluid product to flow through it. The fluid product can flow in and discharge out from the longitudinal channel of the tube through the channel of the connector.

Further, the connector includes one coupling groove and one coupling protrusion, wherein the coupling groove is provided on an inner circumferential surface of the lower portion, and the coupling protrusion is provided on the outer peripheral surface of the upper portion of the connector. Additionally, both the coupling groove and protrusion can be constructed of any diameter and depth. Further, the connector may be of any shape or include various structures.

According to an aspect of the present disclosure, the applicator tip may be secured to the connector, for example, by a press-fit, snap-fit, adhesive, and/or engagement by one or more engagement features or by any other means of engagement known in the art. In an embodiment, the upper portion of the applicator tip includes at least one coupling protrusion that is received in the at least one coupling groove present on the inner circumferential surface of the lower portion of the connector, in order to snap couple the applicator tip with the connector.

According to another aspect of the present disclosure, the tube includes at least one coupling groove formed on an inner periphery near the proximal end portion of the tube. Further, the coupling protrusion present on the upper portion of the connector is received and fitted into the coupling groove of the tube for coupling the connector to the tube. In various embodiments, the connector may be secured to the tube by a press-fit, snap-fit, adhesive, and/or engagement by one or more engagement features or by any other means of engagement known in the art.

According to an aspect of the present disclosure, a series of channels is defined in an inner periphery of the dropper assembly. In an embodiment, a dispensing channel extending from one end to another end of the connector is in precise and through and through connection with the dispensing channel of the applicator tip. Further, both the dispensing channels of the applicator tip and the connector respectively are connected in such a manner that both the dispensing channels come in a straight longitudinal alignment and form a continuous channel for intake, storage, and discharge of the fluid product. Intake of the fluid product inside the dispensing channel as well as the release of the fluid product is done through the dispensing orifice. Further, the fluid product released from an orifice of the applicator tip is held within the central through cavity so that it can be applied to the skin of the user.

According to an aspect of the present disclosure, the push button is configured to moves axially along the longitudinal axis of the package between the highest position and the lowest position when a force is applied or released from the push button. In use, when the push button is pressed slowly towards its lowest position, it causes the deformable bulb to deform reducing the interior volume of the chamber of the deformable bulb and ready the dropper assembly for drawing fluid product out of the container body. Releasing the push button allows the chamber of the deformable bulb to return to its original volume and shape, drawing the fluid product into the dispensing orifice in the applicator tip and up into the channel in the tube through channels of the applicator tip and the connector respectively. To dispense the drawn-in product, when the channel of the tube is already filled with a predetermined quantity of fluid product, in that case, the push button is pressed slowly towards its lowest position, causing the deformable bulb to deform as a result the fluid product discharges out in a controlled manner from the dispensing orifice on the applicator tip. More particularly, when pressure is applied by the squeezing action to the deformable bulb, the fluid product in the tube is forced to dispense out through the orifice via dispensing channels, and for application to the user's skin. The fluid product released from the dispensing orifice comes directly onto the inner periphery of the applicator tip, which surrounds the central through cavity and creates a surface tension to prevent the fluid from falling and wasting. When the user's skin touches the applicator tip it breaks the surface tension and releases the fluid product held by the surface tension onto the user's keratinous surface.

In alternate embodiment, the applicator tip may be directly connected to the tube without the use of an intermediate connector.

According to an aspect of the present disclosure, the container body that defines a reservoir for filling with fluid may be made of a rigid material like glass, metal, hard plastic, or any other material known in the art. However, in alternate embodiments, the container body is made of glass material. The container body material is non-reactive with the fluid product stored in the reservoir. In other implementations, the container body may be made of virtually any other material that is non-reactive or resistant to the fluid product being dispensed, such as various metals, plastics, glass, composites, or the like.

According to an aspect of the present disclosure, the cosmetic package is of an elongated cylindrical configuration. However, in alternate embodiments, the cosmetic package may be of an elongated square, polygonal configuration, oval, triangular, heart, or any other configuration known in the art.

According to an embodiment, the cap may be made of a rigid material like metal, hard plastic, or any other material known in the art. However, in alternate embodiments, the cap may be made of a rigid thermoplastic material like; acrylonitrile-butadiene-styrene (ABS); polyethylene (PE); polypropylene (PP), or any other material known in the art.

According to an embodiment of the present disclosure, the connector is made of plastic, wherein the plastic may be selected from the following list: thermoplastic materials; polyethylene (PE); polyethylene terephthalate (PET); polypropylene (PP); this list not being limiting. In an alternate embodiment, the connector can be made of a material selected from plastic, steel, and metal.

According to an embodiment of the present disclosure, the tube, is made of plastic, wherein the plastic may be selected from the following list: thermoplastic materials; polyethylene (PE); polyethylene terephthalate (PET); polypropylene (PP); this list not being limiting. In an alternate embodiment, the tube can be made of a material selected from glass, metal, steel, or plastic.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modify to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
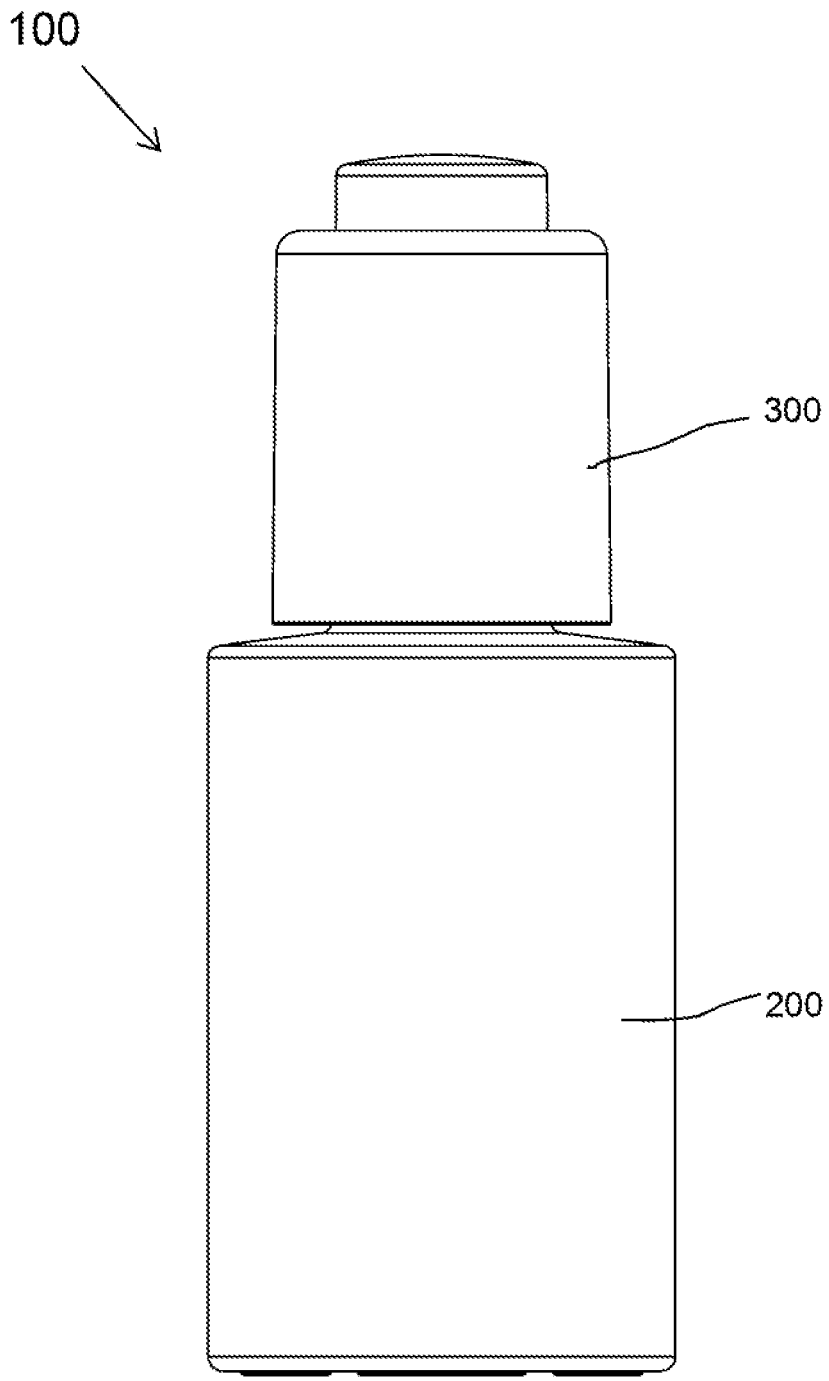
FIG. 1 illustrates a front view of a dropper package according to a preferred embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

FIG. 1 shows an illustrative front view of a dropper package 100 in accordance with the present disclosure. The dropper package 100 comprises a container body 200 and a dropper assembly 300 secured to the container body 200. The dropper assembly 300 includes a cap 120 configured to be coupled to the container body 200 when the cosmetic package 100 is not in use. This dropper package 100 extends longitudinally along a longitudinal X-axis. The container body 200 comprises a hollow reservoir 201 (refer FIG. 2) for containing a fluid product (not shown) including a cosmetic, care, or pharmaceutical product. The cosmetic, care or pharmaceutical product includes fluidic cosmetics, gloss, serum, skincare, under-eye cosmetics, pharmaceutical, and like products.

Figure 2:
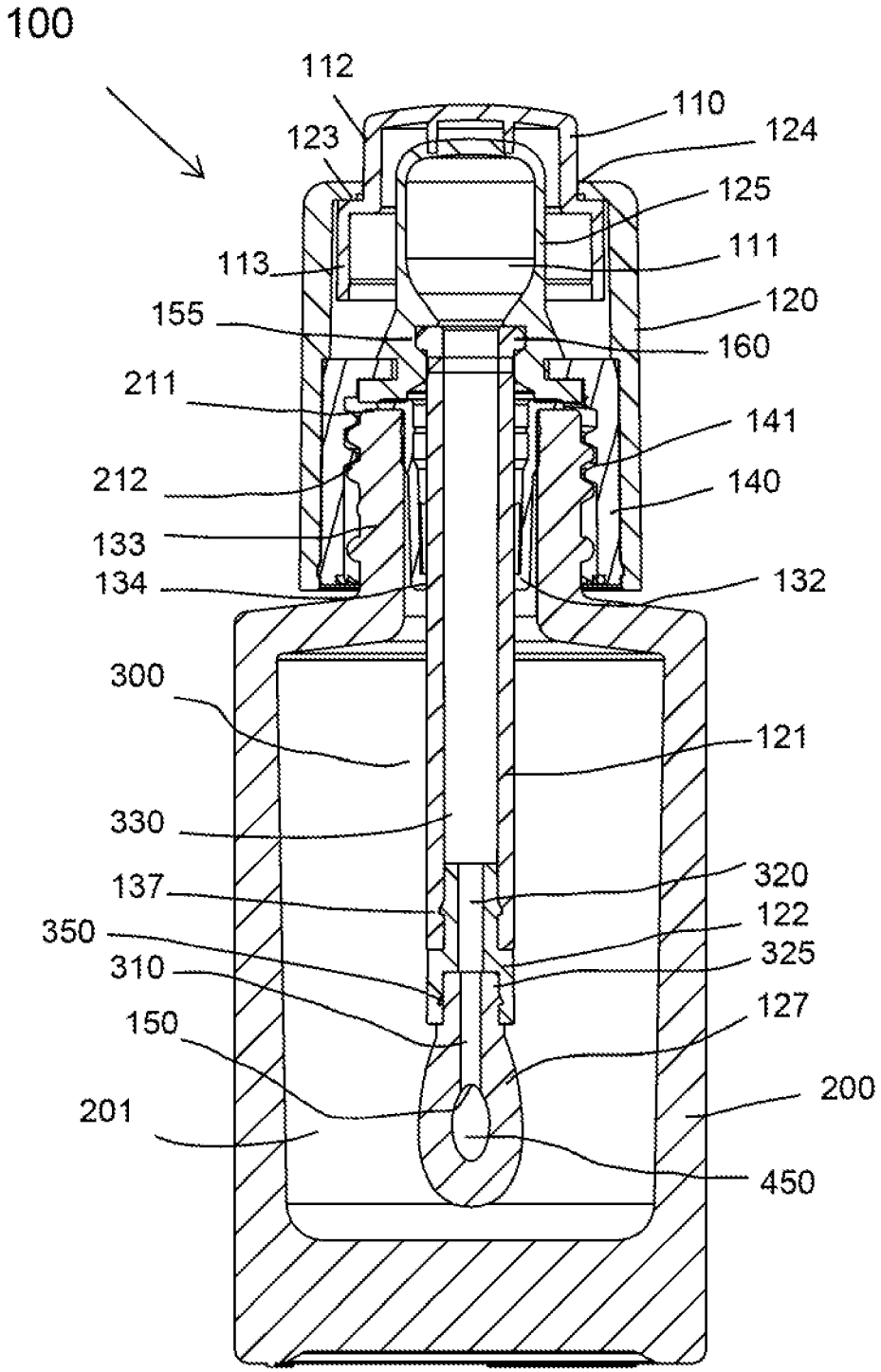
FIG. 2 illustrates a longitudinal cross sectional view of the dropper package of FIG. 1.

FIG. 2 shows a cross sectional view of the dropper package 100 includes a dropper assembly 300. The dropper assembly 300 includes a push button 110, the cap 120, an inner screw member 140, a deformable bulb 125, a tube 121, a connector 122 and an applicator tip 127, as seen in the FIGS. 2-4. The tube 121 and the applicator tip 127 are adapted to be inserted into the container body 200 containing the fluid product when the cap 120 is engaged onto the container body 200.

Figure 3:
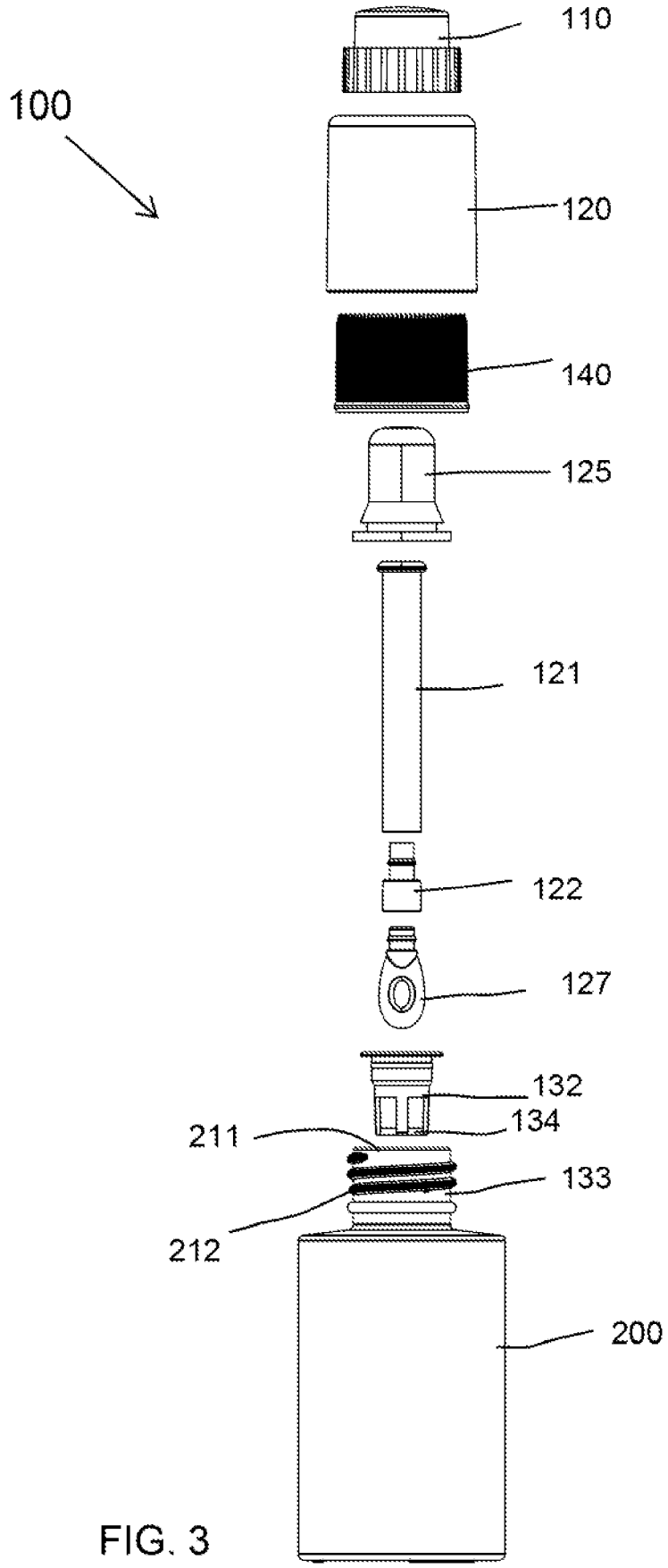
FIG. 3 illustrates an exploded view of the dropper package of FIG. 1.

Referring to FIGS. 2-3, an upper portion of the container body 200 forms a neck portion 133 and defines an opening 211 at its upper end. The neck portion 133 of the container body 200 has screw threads 212 formed on an outer peripheral surface thereof. The screw threads 212 of the container body 200 are configured to be screwed with the inner screw member 140 of the dropper assembly 300 to seal the container body 200. The inner screw member 140 is provided at a lower inner side of the cap 120 and has screw threads 141 formed at an inner circumferential surface thereof. The screw threads 141 of the inner screw member 140 are screwed with the screw threads 212 of the container body 200 to open and close the container body 200.

Referring to FIG. 2, the cap 120 is coupled to the push button 110 at an upper end thereof. Furthermore, the cap 120 has an opening 124 defined at the center of a top surface 123 of the cap 120. The top surface 123 of the cap 120 is formed as a locking surface 123 that surrounds the opening 124. When the push button 110 is coupled to an upper inner side of the cap 120, the locking surface 123 does not allow the push button 110 to be separated from the cap 120. Furthermore, the push button 110 has a cylindrical upper wall 112 and a cylindrical lower wall 113 that is stepped out from the cylindrical upper wall 112. The cylindrical upper wall 112 of the push button 110 has a diameter lesser than the opening 124 of the cap 120 so that the cylindrical upper wall 112 projects out from the opening 124, and the cylindrical lower wall 113 has a diameter greater than the diameter of the opening 124 of the cap 120 such that the cylindrical lower wall 113 of the push button 110 is retained inside the cap 120 and the push button 110 cannot be separated from the cap 120.

As seen in FIG. 2, a wiper 132 is fitted into the opening 211 of the container body 200. The wiper 132 is attached to the inner periphery of the neck portion 133 of the container body member 200. A wiper lip 134 is formed at the lower end of the wiper 132 through which the tube 121 and the applicator tip 127 enter and exit the reservoir 201, and the wiper lip 134 serves to sweep off the extra product on the tube 121 and the applicator tip 127. The wiper 132 is preferably cylindrical including a central cavity. The wiper 132 may include a plurality of incisions either extending radially or longitudinally or both. In addition, the wiper 132 is preferably a cosmetic recovery portion that is meant to minimize the loss of fluid products by sweeping the fluid product from the assembly i.e. the tube 121, the connector 122, and the application tip 127.

In an embodiment, the wiper 132 is made of plastic material. In various embodiments, the plastic material is selected from low-density polyethylene (LDPE) or polyethylene (PE).

Further, as shown in FIG. 2, the deformable bulb 125 is housed inside the cap 120, and the tube 121 is coupled to a lower portion of the deformable bulb 125. The deformable bulb 125 is preferably made of a material that is deformed by a pressing operation of the push button 110 and then restored to its original state, in particular, natural rubber, elastomer, NBR (acrylonitrile-butadiene rubber), silicone. The deformable bulb 125 may be formed of one or more materials of rubber. More particularly, the deformable bulb 125 is made of any standard appropriate oil-resistant elastic material for supporting the tube 121. The elastic material should exhibit a predetermined strength or elasticity and is selected from nitrile-butadiene-rubber or acrylonitrile butadiene rubber, polycarbonate, acrylic resin, or the like.

The deformable bulb 125 is housed inside the cap 120 such that an upper portion of the deformable bulb 125 is located inside the push button 110. The tube 121 is centrally and longitudinally inserted inside the deformable bulb 125. The deformable bulb 125 has a fastening groove 155 formed on an inner side thereof at a lower portion of the deformable bulb 125, and an upper portion of the tube 121 is fixedly coupled to the fastening groove 155. More particularly, the upper portion of the tube 121 has a locking projection 160 is formed at an outer surface of the tube 121 and wherein the locking projection 160 is adapted to be fixedly coupled to the fastening groove 155 of the deformable bulb 125 so that the tube 121 is not separated from the deformable bulb 125. More particularly, the tube 121 is fixedly and air-tightly coupled inside the fastening groove 155 portion of the deformable bulb 125.

Figure 4:
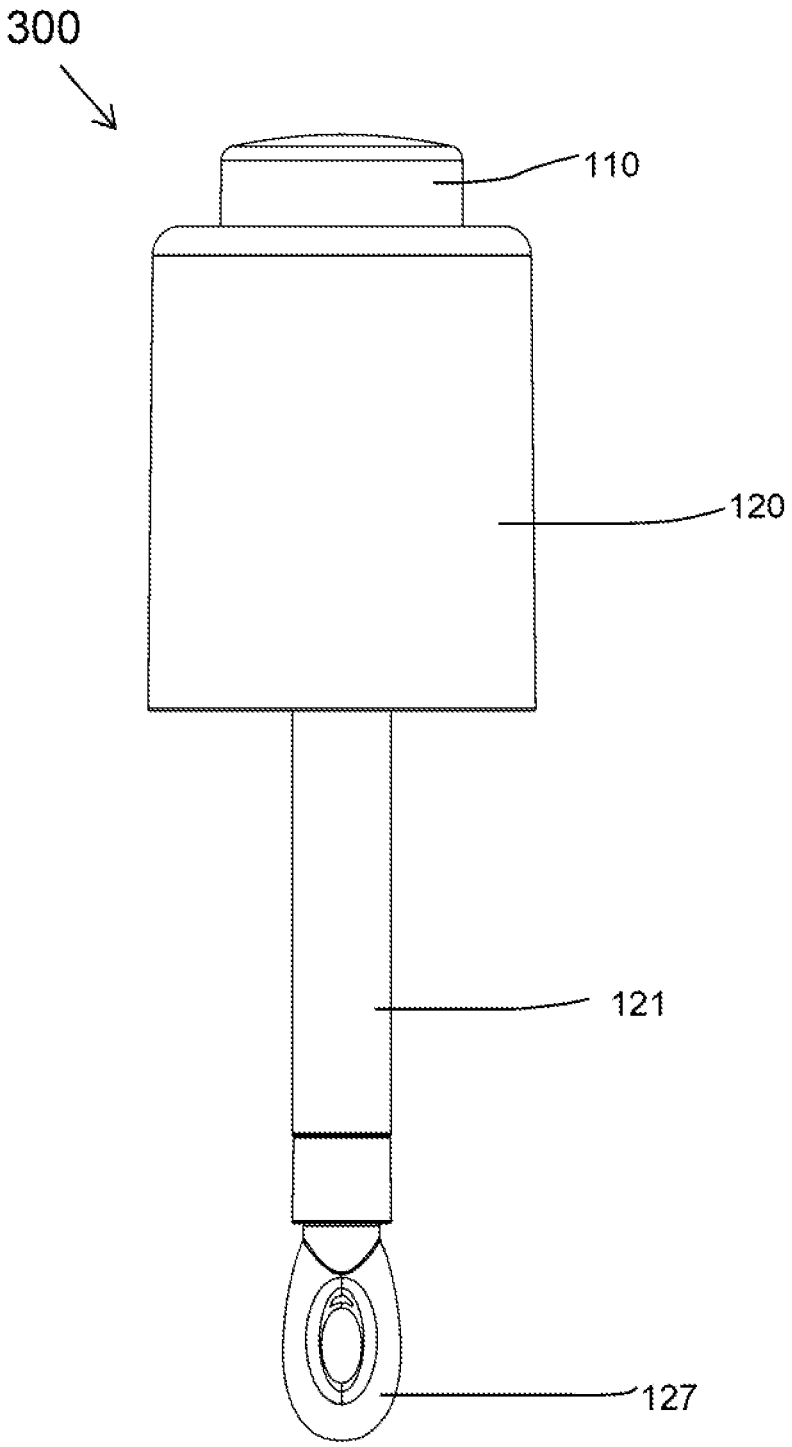
FIG. 4 illustrates an front view of an dropper assembly of the dropper package of FIG. 1.

As seen in FIGS. 2 and 4, the applicator tip 127 is present at the lower end of the tube 121. The applicator tip 127 is designed to dispense, and apply the fluid product in a controlled manner as well as massage the user's surface. Particularly, the applicator tip 127 is connected to the lower end of the tube 121 through the connector 122 for fluid product delivery onto the user keratinous surface. Further, the tube 121 is elongated cylindrical and is hollow defining a channel 330 there through for storing a predetermined amount of fluid product from the reservoir 20 therein. The channel 330 may be in fluid communication with an interior chamber 111 in the deformable bulb 125 and with a channel 130 and a dispensing orifice 150 in the applicator tip 127.

Referring to FIGS. 2, the applicator tip 127 is elongated along the longitudinal axis of the dropper package 100 and has a body that is elliptical with a central through cavity 450 formed at the center of the body. In alternate embodiments, however, the applicator tip 127 may have any other suitable shape and size as long as it has a central through cavity 450. In the present embodiment, the applicator tip 127 is made of a thermal material that can retain heat and provide a cooling sensation upon contact with the user's skin. The thermal material preferably is ceramic. In alternate embodiments, the applicator tip 127 may be made of glass, steel, ceramic, or metals, wherein the metal is selected from but not limited to silver, stainless steel, platinum, aluminum, gold, copper, brass, nickel, alloys thereof.

Figure 7A:
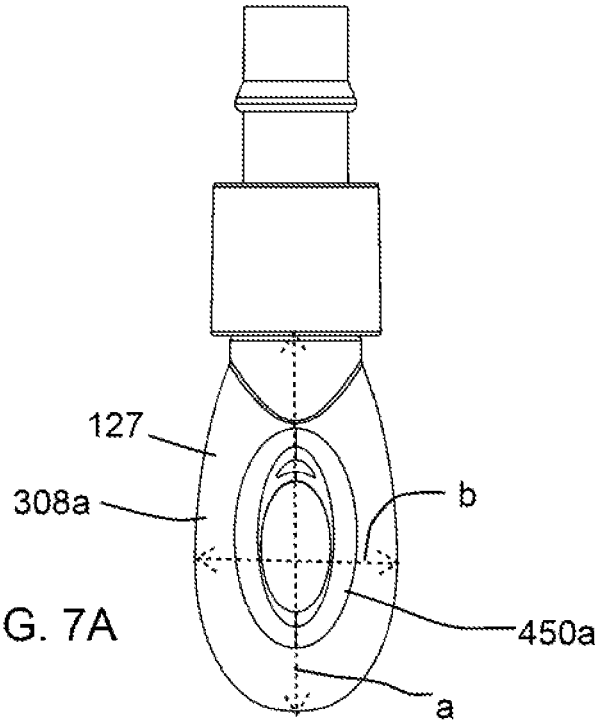
FIG. 7A illustrates a front view of an assembly comprising an applicator tip and a connector of the dropper package of FIG. 3.
Figure 7B:
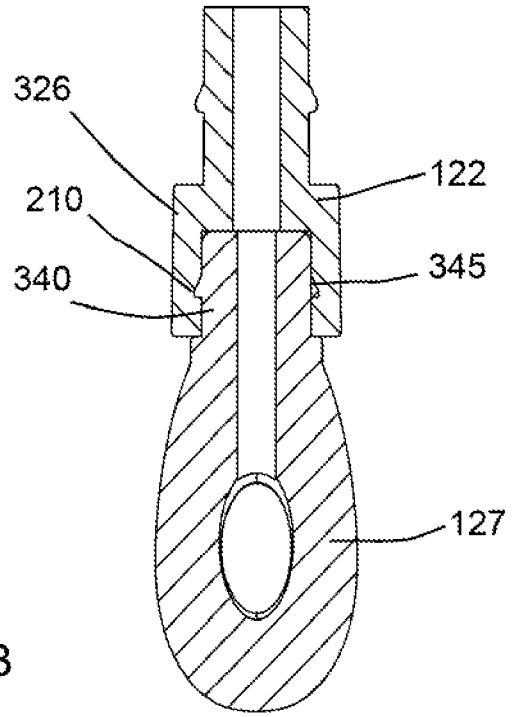
FIG. 7B illustrates a cross-sectional view of the assembly of the applicator tip and the connector of FIG. 7A.
Figure 7C:
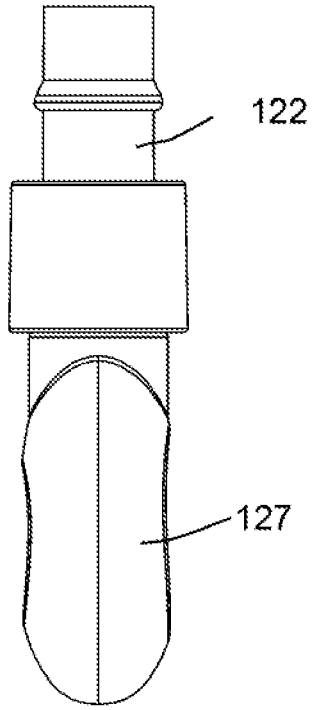
FIG. 7C illustrates a side view of the assembly of the applicator tip and the connector of FIG. 7A.

As seen in FIGS. SA-5D, the applicator tip 127 has a cylindrical connecting structure 340 formed at its proximal end and wherein the cylindrical connecting structure includes a protrusion structure 345 on an outer periphery for ensuring a precise connection/fitment with the connector 122, see FIG. 7B. Further, the applicator tip 127 has a generally symmetrical shape body with respect to a median plane of symmetry and comprises the central through cavity 450 which is delimited laterally by two lateral portions or branches 128 and axially by a distal portion 129*a* and a proximal portion 129*b* of the applicator tip 127, joining the branches 128. The central through cavity 450 is elongated in shape and extends along the branches 128 which are made of a rigid thermal material.

Figure 5A:
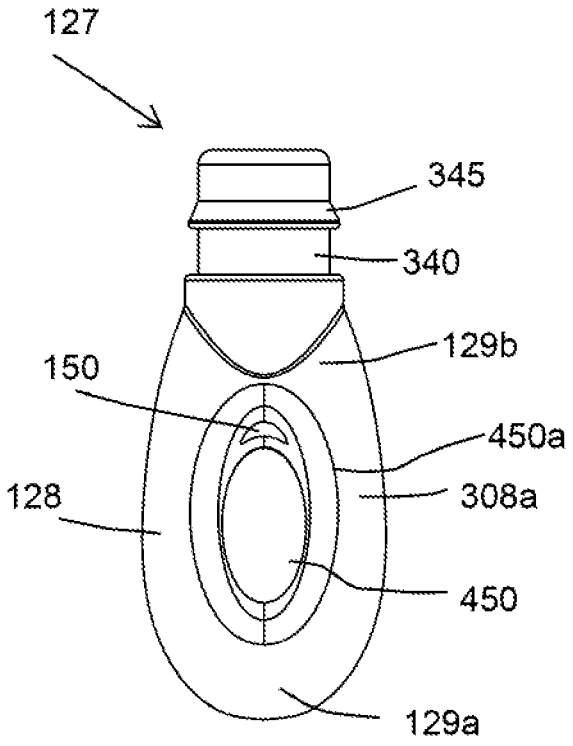
FIG. 5A illustrates a front view of an applicator tip of the dropper package of FIG. 3.
Figure 5B:
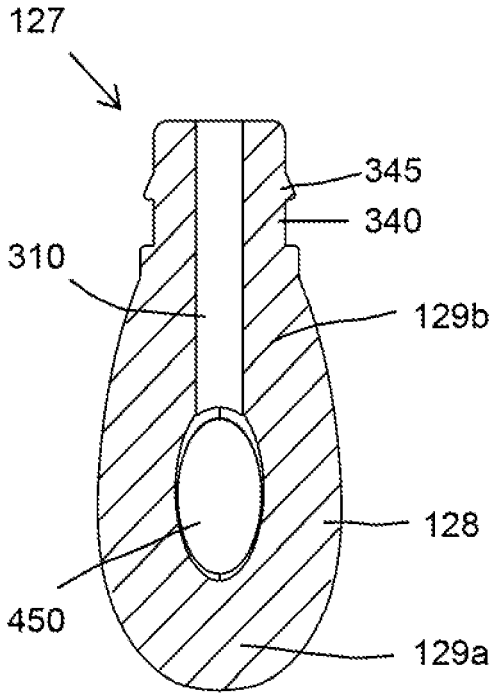
FIG. 5B illustrates a cross-sectional view of the applicator tip of FIG. 5A.
Figure 5C:
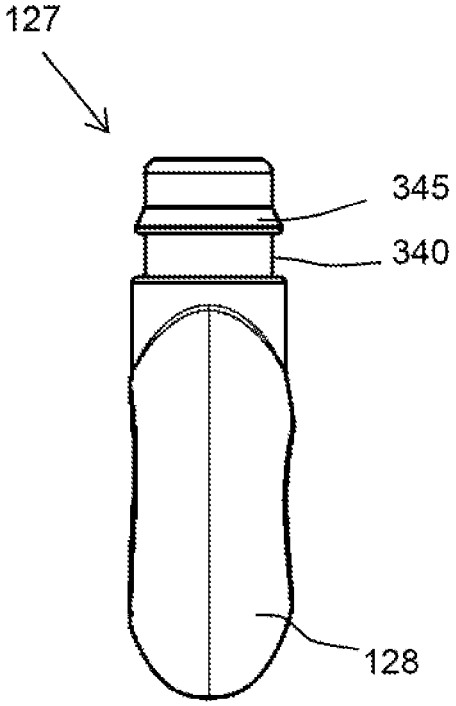
FIG. 5C illustrates a side view of an applicator tip of FIG. 5A.
Figure 5D:
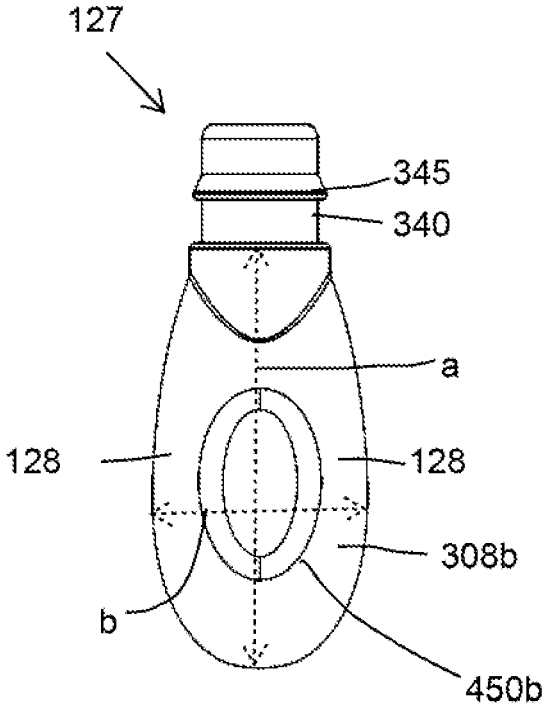
FIG. 5D illustrates a rear view of the applicator tip of FIG. 5A.

As shown in FIGS. 5A, 5B and 5D, the central through cavity 450 has an elliptical shape. In the present embodiment, the central through cavity 450 formed on the applicator tip 127 is oval or elliptical, and also helps in forming surface tension in fluid product dropped on the inner periphery of the applicator tip 127. In alternate embodiments, however, the central through cavity 450 may have any other suitable shape and size, and surface finish desired for a given application of the fluid product unless the surface tension is broken when in contact with the user's skin during application.

Figure 7D:
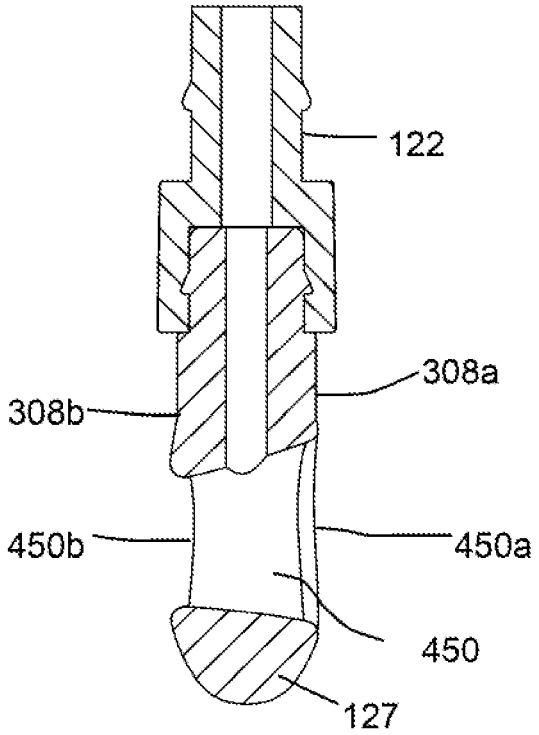
FIG. 7D illustrates another cross-sectional view of the assembly of the applicator tip and the connector of FIG. 7C.

Furthermore, the applicator tip 127 comprises at least two main application faces i.e. a front application face 308*a* (see FIG. 5A) and a back application face 308*b* (see FIG. 5D). Both the front application face 308*a* and back application face 308*b* are opposite to each other and are symmetrical in structure. Further, the central through cavity 450 is open to the outside through both the front and back application faces 308*a* and 308*b*, refer FIG. 7D. Referring to FIGS. 5A-5D both the front application face 308*a*, and back application face 308*b* are elliptical and have convex outer surfaces. In alternate embodiment, however, the applicator faces 308*a* and 308*b* may have any other suitable shape and size, and surface finish desired for a given application. The convex outer surface of the application faces 308*a* and 308*b* enable precise massage of small or narrow areas of the user's keratinous surface such as upper lips, under eye, etc.

The front and back application faces 308*a*, 308*b* are intended to come into contact with the skin during the use of the applicator tip 127, in order to apply the fluid product contained in the central through cavity 450. The central through cavity 450 opens onto the front application face 308*a* through a front opening 450*a* (see FIGS. 5A and 7D) and the central through cavity 450 is open on the outside of the opposite side to the front application face 308*a* on the back application face 308*b* by a back opening 450*b* (see FIGS. 5D and 7D). The size of the front opening 450*a* of the central through cavity 450 is larger than that of the back opening 450*b*, in particular at least by 20%, see FIG. 7D. In the illustrated example, the central through cavity 450 is conical with an elliptical cross-section and extends in a direction perpendicular to the longitudinal axis X. In other words, the central through cavity 450 is an elliptical cone-shaped cavity. The front opening 450*a* and back opening 450*b* are both elliptical. Referring to FIGS. 5A and 5D, the dispensing orifice 150 is visible from the front application face 308*a* not from the back application face 308*b* as the dispensing orifice 150 is located on the inner periphery of the applicator tip 127 which is conical.

The applicator tip 127 further includes an interior dispensing channel 310 that extends from a proximal end of the connecting structure 340. The dispensing channel 310 terminates in the dispensing orifice 150 formed on an inner periphery of the applicator tip 127 at the proximal portion 129*b* and faces the central through cavity 450, as shown in FIGS. 5A and 5B. In other words, the interior dispensing channel 310 of the applicator tip 127 opens into the central through cavity 450 for the delivery of the cosmetic or pharmaceutical fluid product. The dispensing orifice 150 does not lie or opens on the front application face 308*a* or the back application face 308*b*.

The central through cavity 450 makes it possible to collect fluid product by surface tension so that the fluid product does not run off a collection surface formed by inner surfaces of the branches 128 facing the central through cavity 450. Thus, the central through cavity 450 increase the loading capacity of the applicator tip 127. In the present embodiment, the branches 128 of the applicator tip 127 are in form of arches that are convex toward the outside and concave towards the central through cavity 450 defining a product collection surface. In the other words, the product collection surface, at least partially, is formed by the concave surfaces of the arched branches. The fluid product collects in the central through cavity 450, which is at least partially formed by the branches 128, thereby favoring the retention of the fluid product by surface tension. The central through cavity 450 is open toward the outside, from the front and back application faces 308*a*, 308*b*, in which the fluid product can collect by surface tension while remaining easily accessible for the user's skin.

The central through cavity 450 extends over more than a quarter of the width b of the applicator tip 127 as well as over more than a quarter of its length a. Preferably, the front opening 450*a* of the central through cavity 450 extends over more than a third of the width b of the applicator tip 127 on the front application face 308*a* and extend over more than half of the length of the applicator tip 127 on the front application face 308*a*, refer FIG. 7A. Preferably, the back opening 450*b* of the central through cavity 450 extends over more than a third of the width b of the applicator tip 127 on the back application face 308*b* and extend over more than a third of the length of the applicator tip 127 on the back application face 308*b*, refer FIG. 5A. This dimension is suitable for storing the fluid product. The central through cavity 450 is spaced from the proximal and distal ends of the applicator tip 127, see FIG. 5A. It has a maximum depth of dimension such that is easier to empty the central through cavity 450 on contact with the skin. The maximum depth of the central through cavity 450 is less than 6 mm, preferably between 1 mm to 5 mm. The dimensions of the central through cavity 450 can be chosen as a function of the quantity of product which it is desired to have optionally retained. Preferably, the dimensions of the central through cavity 450 and of the applicator tip 127 are the following, the maximum width of the central through cavity 450 on the front application face 308*a*, measured perpendicular to the longitudinal axis X of the applicator tip 127, is between 2 mm and 7 mm, and preferably between 2 mm and 4 mm, the maximum width of the central through cavity 450 on the back application face 308*b*, measured perpendicular to the longitudinal axis X of the applicator tip 127, is between 2 mm and 7 mm, and preferably between 2 mm and 4 mm, the maximum length of the central through cavity 450 on the front application face 308*a*, measured along the longitudinal axis X of the applicator tip 127 is between 6 mm and 10 mm, and preferably between 6 mm and 8 mm, the maximum length of the central through cavity 450 on the back application face 308*b*, measured along the longitudinal axis X of the applicator tip 127 is between 4 mm and 8 mm, and preferably between 4 mm and 6 mm. The maximum width "b" (see FIG. 7A) of the applicator tip 127, measured perpendicular to the longitudinal axis X of the applicator tip is between 5 mm and 15 mm, and preferably between 7 mm and 10 mm, the length "a" (see FIG. 7A) of the applicator tip 127, measured along the longitudinal axis X of the applicator surface, is between 10 mm and 18 mm, and preferably between 11 mm and 15 mm.

According to a preferred embodiment, as shown in FIGS. 7A and SD, the front opening 450*a* forms a larger elliptical opening than the elliptical opening formed by the back opening 450*b* of the central through cavity 450. The major axis of the elliptical opening formed by the front opening 450*a* measures about 7-8 mm and the minor axis of the elliptical opening formed by the front opening 450*a* measures about 3-4 mm. The minor axis of the elliptical opening formed by the back opening 450*b* measures about 5-6 mm and the minor axis of the elliptical opening formed by the back opening 450*b* measures about 2-3 mm.

Figure 6A:
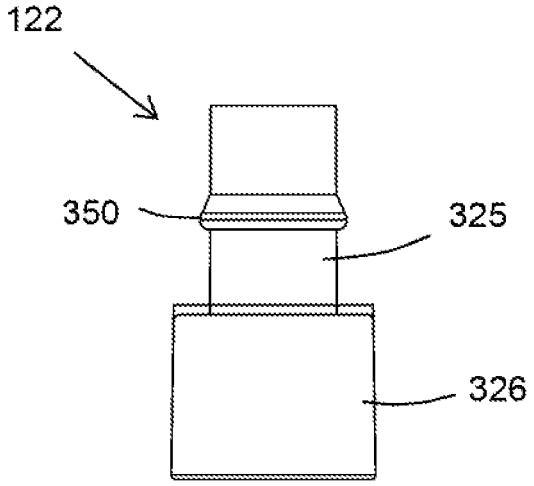
FIG. 6A illustrates a front view of an connector of the dropper package of FIG. 3.
Figure 6B:
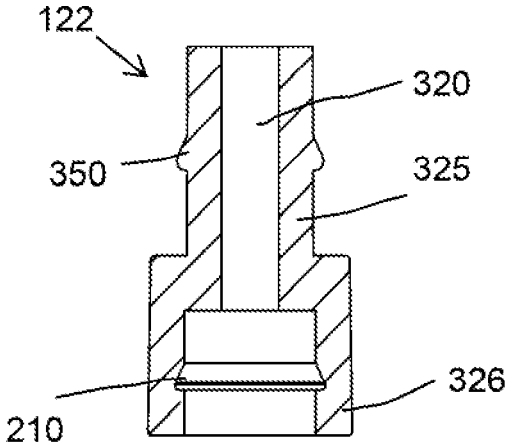
FIG. 6B illustrates a cross-sectional view of the connector of FIG. 6A.

Referring to FIGS. 6A and 6B, the connector 122 includes an upper portion 325 and a lower portion 326. The upper portion 325 and the lower portion 326 both are cylindrical. The upper portion 325 has a diameter lesser than the diameter of the lower portion 326 of the connector 122. The upper portion 325 of the connector 122 is coupled to a lower portion of the tube 121 and the lower portion 326 of the connector 122 is coupled to an upper portion 340 of the applicator tip 127, refer FIG. 2. The connector 122 is hollow that defines a channel 320 to allow the fluid product to flow through it. The fluid product can flow in and discharge out from the longitudinal channel 330 of the tube 121 through the channel 320 of the connector 122.

Further, the connector 122 includes one coupling groove 210 and one coupling protrusion 350, wherein the coupling groove 210 is provided on an inner circumferential surface of the lower portion 326, and the coupling protrusion 350 is provided on the outer peripheral surface of the upper portion 325 of the connector 122. Additionally, both the coupling groove 210 and protrusion 350 can be constructed of any diameter and depth. Further, the connector 122 may be of any shape or include various structures.

According to an aspect of the present disclosure, the applicator tip 127 may be secured to the connector 122, for example, by a press-fit, snap-fit, adhesive, and/or engagement by one or more engagement features or by any other means of engagement known in the art. In the exemplary embodiment, referring to FIGS. 7B, the upper portion 340 of the applicator tip 127 includes at least one coupling protrusion 345 that is received in the at least one coupling groove 210 present on the inner circumferential surface of the lower portion 326 of the connector 122, in order to snap couple the applicator tip 127 with the connector 122.

Referring to FIG. 2, the tube 121 includes at least one coupling groove 137 formed on an inner periphery near the proximal end portion of the tube 121. Further, the coupling protrusion 350 present on the upper portion 325 of the connector 122 is received and fitted into the coupling groove 137 of the tube 121 for coupling the connector 122 to the tube 121. In various embodiments (not shown), the connector 122 may be secured to the tube 121 by a press-fit, snap-fit, adhesive, and/or engagement by one or more engagement features or by any other means of engagement known in the art.

Referring to FIG. 2 in a cross-sectional view, a series of channels is defined in an inner periphery of the dropper assembly 300. In an embodiment, a dispensing channel 320 extending from one end to another end of the connector 122 is in precise and through and through connection with the dispensing channel 310 of the applicator tip 127. Further, both the dispensing channels 310, and 320 of the applicator tip 127 and the connector 122 respectively are connected in such a manner that both the dispensing channels 310, 320 come in a straight longitudinal alignment, and form a continuous channel for intake, storage, and discharge of the fluid product. Intake of the fluid product inside the dispensing channel 310 as well as the release of the fluid product is done through the dispensing orifice 150. Further, the fluid product released from an orifice 150 of the applicator tip 127 is held within the central through cavity 450 so that it can be applied to the skin of the user.

According to an aspect of the present disclosure, the push button 110 is configured to moves axially along the longitudinal axis of the package between the highest position and the lowest position when a force is applied or released from the push button 110. In use, when the push button 110 is pressed slowly towards its lowest position, it causes the deformable bulb 125 to deform reducing the interior volume of the chamber 111 of the deformable bulb 125 and ready the dropper assembly 300 for drawing fluid product out of the container body 200. Releasing the push button 110 allows the chamber 111 of the deformable bulb 125 to return to its original volume and shape, drawing the fluid product into the dispensing orifice 150 in the applicator tip 127 and up into the channel 330 in the tube 121 through channels 310, 320 of the applicator tip 127 and the connector 122 respectively. To dispense the drawn-in product, when the channel 330 of the tube 121 is already filled with a predetermined quantity of fluid, in that case, the push button 110 is pressed slowly towards its lowest position, causing the deformable bulb 125 to deform as a result the fluid product discharges out in a controlled manner from the dispensing orifice 150 on the applicator tip 127. More particularly, when pressure is applied by the squeezing action to the deformable bulb 125, the fluid product in the tube 121 is forced to dispense out through the dispensing orifice 150 via dispensing channels 310, and 320 for application to the user's skin. The fluid product released from the dispensing orifice 150 comes directly onto the inner periphery of the applicator tip 127, which surrounds the central through cavity 450 and creates a surface tension to prevent the fluid from dripping and wasting. When the user's skin touches the applicator tip 127 it breaks the surface tension and releases the fluid product held by the surface tension onto the user's keratinous surface.

Figure 8:
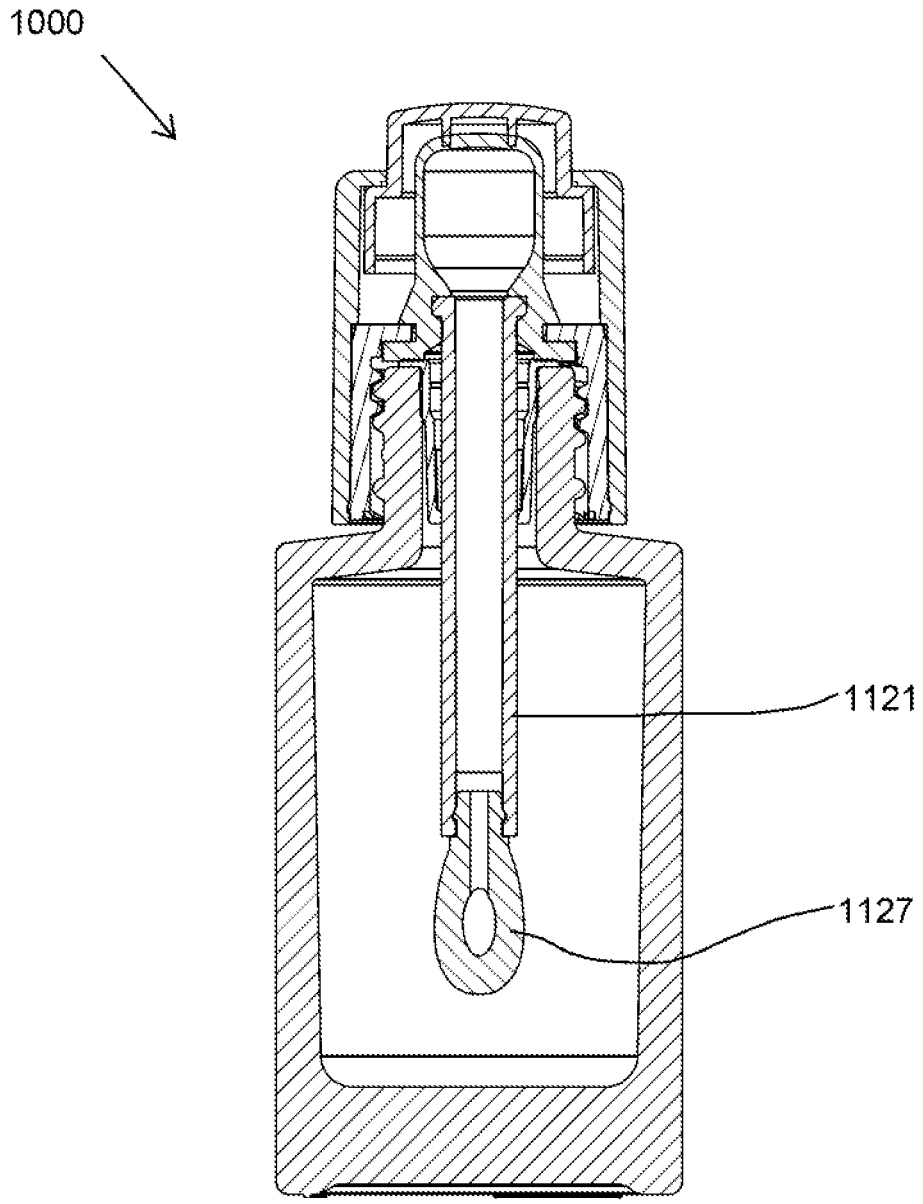
FIG. 8 illustrates a longitudinal cross sectional view of a dropper package according to second embodiment of the present disclosure.

FIG. 8 shows a dropper package 1000 according to a second embodiment of the present disclosure. The dropper package 1000 is similar to the dropper package 100 except in that the applicator tip 1127 is directly connected to the tube 1121 without the use of an intermediate connector.

The container body 200 that defines a reservoir 201 for filling with fluid may be made of a rigid material like glass, metal, hard plastic, or any other material known in the art. However, in alternate embodiments, the container body 200 is made of glass material. The container body material is non-reactive with the fluid product stored in the reservoir 201. In other implementations, the container body 200 may be made of virtually any other material that is non-reactive or resistant to the fluid product being dispensed, such as various metals, plastics, glass, composites, or the like.

According to an aspect of the present disclosure, the cosmetic package 100 is of an elongated cylindrical configuration. However, in alternate embodiments, the cosmetic package 100 may be of an elongated square, polygonal configuration, oval, triangular, heart, or any other configuration known in the art.

According to an embodiment, the cap 120 may be made of a rigid material like metal, hard plastic, or any other material known in the art. However, in alternate embodiments, the cap 120 may be made of a rigid thermoplastic material like; acrylonitrile-butadiene-styrene (ABS); polyethylene (PE); polypropylene (PP), or any other material known in the art.

According to an embodiment of the present disclosure, the connector 122 is made of plastic, wherein the plastic may be selected from the following list: thermoplastic materials; polyethylene (PE); polyethylene terephthalate (PET); polypropylene (PP); this list not being limiting. In an alternate embodiment, the connector 122 can be made of a material selected from plastic, steel, and metal.

According to an embodiment of the present disclosure, the tube 121, 1121 is made of plastic, wherein the plastic may be selected from the following list: thermoplastic materials; polyethylene (PE); polyethylene terephthalate (PET); polypropylene (PP); this list not being limiting. In an alternate embodiment, the tube 121, 1121 can be made of a material selected from glass, metal, steel, or plastic.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A dropper package for a fluid product, the dropper package comprising:

a container body comprising a hollow reservoir for containing a fluid product;

a cap removably coupled to the container body;

a deformable bulb coupled to the cap, the deformable bulb defining an interior chamber;

a tube coupled to a distal portion of the deformable bulb;

an applicator tip coupled to a distal end of the tube;

wherein the tube has a channel that is in fluid communication with the interior chamber of the deformable bulb;

wherein the applicator tip includes a dispensing channel that is in fluid communication with the channel of the tube;

wherein the applicator tip comprises a front application face and a back application face opposing the front application face;

wherein the applicator tip includes a proximal portion, a distal portion, and two lateral branches;

wherein the two lateral branches are joined to the proximal and distal portions of the applicator tip;

wherein the applicator tip includes a central through cavity that is open to the outside through both the front and back application faces, the central through cavity is delimited laterally by two lateral branches and axially by the distal portion of the applicator tip and a proximal portion of the applicator tip;

wherein the dispensing channel of the applicator tip extends through the proximal portion of the applicator tip and terminates in a dispensing orifice on an inner periphery of the applicator tip that opens into the central through cavity; and wherein the applicator tip is made from a thermal material capable of providing cold sensation on contact with the skin.

2. The dropper package according to claim 1, wherein the thermal material is metal or ceramic.

3. The dropper package according to claim 1, wherein the dropper assembly includes a push button, the cap, an inner screw member, the deformable bulb, the tube, a connector, and the applicator tip.

4. The dropper package according to claim 3, wherein the push button is coupled to an upper end portion of the cap; the deformable bulb is housed inside the cap, and wherein the applicator tip is connected to a lower end of the tube through the connector.

5. The dropper package according to claim 4, wherein the tube includes at least one coupling groove formed on an inner periphery near a proximal end portion of the tube; and wherein a coupling protrusion present on an outer upper portion of the connector is received and fitted into the at least one coupling groove of the tube for coupling the connector to the tube.

6. The dropper package according to claim 4, wherein a cylindrical connecting structure is formed at an upper end of the applicator tip; wherein the connecting structure includes at least one coupling protrusion on an outer surface thereof that is received in at least one coupling groove present on an inner circumferential surface of a lower portion of the connector.

7. The dropper package according to claim 1, wherein the applicator tip is elongated along a longitudinal axis of the dropper package and has a body that is elliptical along the longitudinal axis of the dropper package.

8. The dropper package according to claim 1, wherein, the central through cavity is conical with an elliptical cross-section, and wherein a depth of the central through cavity extends in a direction perpendicular to the longitudinal axis of the dropper package.

9. The dropper package according to claim 1, wherein the central through cavity opens on the front application face through a front opening and on the back application face through a back opening; and wherein the size of the front opening of the central through cavity is at least 20% larger than that of the back opening.

10. The dropper package according to claim 9, wherein the front opening of the central through cavity extends over more than a third of the width of the applicator tip on the front application face and extends over more than half of the length of the applicator tip on the front application face; and wherein the back opening of the central through cavity extends over more than a third of the width of the applicator tip on the back application face and extends over more than a third of the length of the applicator tip on the back application face.

11. The dropper package according to claim 9, wherein the front opening forms a larger elliptical opening than an elliptical opening formed by the back opening of the central through cavity on the applicator tip.

12. The dropper package according to claim 11, wherein the elliptical opening formed by the front opening has a major axis that measures about 7-8 mm and a minor axis that measures about 3-4 mm; and wherein the elliptical opening defined by the back opening has a major axis that measures about 5-6 mm and a minor axis that measures about 2-3 mm.

13. The dropper package according to claim 1, wherein a maximum width of the applicator tip, measured perpendicular to a longitudinal axis of the applicator tip, is between 7 mm and 10 mm; and wherein a length of the applicator tip, measured along the longitudinal axis of the applicator tip, is between 11 mm and 15 mm.

14. The dropper package according to claim 1, wherein the two lateral branches of the applicator tip are in form of arches that are convex toward the outside and concave towards the central through cavity; wherein the concave surfaces of the two lateral branches define a product collection surface.

15. The dropper package according to claim 1, wherein the dispensing orifice of the applicator tip is visible from the front application face and not from the back application face.

16. A dropper package for a fluid product, the dropper package comprising:

a container body comprising a hollow reservoir for containing a fluid product;

a cap removably coupled to the container body;

a deformable bulb coupled to the cap and defining an interior chamber;

a tube coupled to a distal portion of the deformable bulb;

an applicator tip coupled to a distal end of the tube;

wherein the tube has a channel that is in fluid communication with the interior chamber of the deformable bulb;

wherein the applicator tip includes a dispensing channel that is in fluid communication with the channel of the tube;

wherein the applicator tip comprises a front application face and a back application face opposing the front application face;

wherein the applicator tip includes a central through-cavity formed at the center of the applicator tip, the central through-cavity is open to the outside through both the front and back application faces;

wherein the dispensing channel of the applicator tip terminates in a dispensing orifice that lies on the inner periphery of the applicator tip and opens into the central through cavity;

wherein the central through cavity opens on the front application face through a front opening and on the back application face through a back opening;

wherein the central through cavity is conical with an elliptical cross-section; and wherein the front opening forms a larger elliptical opening on the front application face than an elliptical opening formed by the back opening on the back application face.

17. The dropper package according to claim 16, wherein the applicator tip is made from a thermal material capable of providing cold sensation on contact with the user's skin; and wherein the thermal material is selected from a glass, metal, or ceramic.

18. The dropper package according to claim 17, wherein the central through cavity opens on the front application face through a front opening and on the back application face through a back opening; and wherein the front opening forms a larger elliptical opening on the front application face than an elliptical opening formed by the back opening on the back application face.

19. The dropper package according to claim 17, wherein the applicator tip is made from a thermal material capable of providing cold sensation on contact with the user's skin; and wherein the thermal material is selected from a glass, metal, or ceramic.

20. A dropper package for a fluid product, the dropper package comprising:

a container body comprising a hollow reservoir for containing a fluid product;

a cap removably coupled to the container body;

a deformable bulb coupled to the cap and defining an interior chamber;

a tube coupled to a distal portion of the deformable bulb;

a connector coupled to a distal inner side of the tube;

an applicator tip coupled to a distal end of the connector;

wherein the tube has a channel that is in fluid communication with the interior chamber of the deformable bulb;

wherein the connector includes a dispensing channel that is in fluid communication with the channel of the tube;

wherein the applicator tip includes a dispensing channel that is in fluid communication with the dispensing channel of the connector;

wherein the applicator tip comprises a front application face and aback application face opposing the front application face;

wherein the applicator tip includes a central through-cavity formed at the center of the applicator tip, the central through-cavity is open to the outside through both the front and back application faces; and wherein the dispensing channel of the applicator tip extends through a proximal portion of the applicator tip and terminates in a dispensing orifice opening into the central through cavity.

* * * * *